US007455024B2

(12) United States Patent
Barber

(10) Patent No.: US 7,455,024 B2
(45) Date of Patent: Nov. 25, 2008

(54) APPARATUS FOR PROTECTING THE HULL OF A WATERCRAFT

(75) Inventor: Allan Barber, Ferny Hills (AU)

(73) Assignee: Sea Pen Holdings Pty. Ltd., Coomera, Queensland (AU)

( * ) Notice: Subject to any disclaimer, the term of this patent is extended or adjusted under 35 U.S.C. 154(b) by 0 days.

(21) Appl. No.: 11/582,660

(22) Filed: Oct. 17, 2006

(65) Prior Publication Data

US 2008/0087208 A1 Apr. 17, 2008

(51) Int. Cl.
*B63B 59/00* (2006.01)

(52) U.S. Cl. ..... 114/222

(58) Field of Classification Search ..... 114/45, 114/222

See application file for complete search history.

(56) References Cited

U.S. PATENT DOCUMENTS

| | | | | |
|---|---|---|---|---|
| 3,626,447 | A | 12/1971 | Hindlin | |
| 3,951,087 | A | 4/1976 | Carson | |
| 3,976,022 | A | 8/1976 | Lapeyre | |
| 4,084,529 | A | 4/1978 | Katernberg | |
| 4,215,644 | A | 8/1980 | Jackson | |
| 4,280,429 | A | 7/1981 | Wells | |
| 4,280,436 | A | 7/1981 | Jackson | |
| 4,280,437 | A | 7/1981 | Jackson | |
| 4,280,438 | A | 7/1981 | Jackson | |
| 4,280,439 | A | 7/1981 | Jackson | |
| 4,282,822 | A | 8/1981 | Jackson | |
| 5,152,242 | A | 10/1992 | Bradley | |
| 5,279,244 | A | 1/1994 | Perez-Collazo | |
| 5,285,743 | A | 2/1994 | Connolly | |
| 5,465,676 | A * | 11/1995 | Falcaro | 114/222 |
| 5,549,069 | A | 8/1996 | Faidi | |
| 5,651,326 | A | 7/1997 | Rice | |
| 5,664,513 | A | 9/1997 | Echelbarger | |
| 5,855,180 | A | 1/1999 | Masters | |
| 5,947,050 | A | 9/1999 | Eva, III et al. | |
| 6,152,061 | A | 11/2000 | Perez-Collazo | |
| 6,431,106 | B1 | 8/2002 | Eva, III et al. | |
| 6,477,968 | B2 | 11/2002 | Powell | |
| 6,568,343 | B1 | 5/2003 | Hill et al. | |
| 6,602,022 | B1 | 8/2003 | Wilkins | |
| 6,688,105 | B1 * | 2/2004 | Shick | 60/641.1 |
| 6,745,714 | B1 | 6/2004 | Faber | |
| 2006/0010783 | A1 * | 1/2006 | Evans | 52/3 |

FOREIGN PATENT DOCUMENTS

| | | | |
|---|---|---|---|
| AU | 2003100664 | A4 | 10/2003 |
| NL | 9401449 | | 9/1994 |
| WO | WO 02/079026 | A1 | 10/2002 |

* cited by examiner

*Primary Examiner*—Stephen Avila
(74) *Attorney, Agent, or Firm*—MacPherson Kwok Chen & Heid LLP; Michael Shenker

(57) ABSTRACT

An apparatus for protecting the hull of a watercraft includes a support. A submersible barrier assembly is connected to the support and is displaceable with respect to the support between an inoperative, submerged position and an operative surface position. The barrier assembly is configured to cover at least a submerged portion of the hull in the operative position. A displacement mechanism is operable on the barrier assembly to displace the barrier assembly between the inoperative and operative positions.

20 Claims, 9 Drawing Sheets

APPARATUS FOR PROTECTING THE HULL OF A WATERCRAFT

FIELD OF THE INVENTION

This invention relates to an apparatus for protecting the hull of a watercraft. More particularly, this invention relates to an apparatus for protecting the hull of a watercraft from fouling while the watercraft is moored.

BACKGROUND TO THE INVENTION

It is well known in the boating industry that fouling of a hull significantly reduces boat performance and economy. It is both time-consuming and expensive to lift a boat from the water to remove barnacles and other foreign matter.

Applicant has conceived the present invention to alleviate the need to remove the boat from the water for the purposes of hull cleaning. In particular, the Applicant has conceived an apparatus that can be used to maintain the hull in a relatively dry condition while the boat is moored in water. It will be appreciated that fouling will be significantly inhibited if the hull can be maintained in a relatively dry state.

SUMMARY OF THE INVENTION

According to the invention, there is provided an apparatus for protecting the hull of a watercraft, the apparatus including a support;

a submersible barrier assembly connected to the support and displaceable with respect to the support between an inoperative, submerged position and an operative surface position, the barrier assembly being configured to cover at least a submerged portion of the hull in the operative position; and a displacement mechanism operable on the barrier assembly to displace the barrier assembly between the inoperative and operative positions.

The support may be in the form of a pair of spaced floats positioned to permit a watercraft to be positioned between the floats when the barrier assembly is submerged.

The barrier assembly may include a frame that bounds a docking zone dimensioned to receive the hull of the watercraft in the operative position.

The barrier assembly may include a barrier sheet that is fast with the frame to span the docking zone and is dimensioned to cover at least the submerged portion of the hull in the operative position. The barrier assembly may include a water-impervious sheet and a drainage sheet that is positioned on the water impervious sheet such that the drainage sheet is interposed between the hull and the water-impervious sheet in the operative position to permit water to drain away from the hull. The drainage sheet may be of a woven material. In particular, the drainage sheet may be in the form of a high-strength rope mat.

The rope mat may be woven of rope of a plastics material. The rope mat may be woven of polypropylene rope.

The frame may be comprised of a number of tubular frame elements that together define a flotation chamber which can be flooded and evacuated to submerge and raise the frame, respectively.

The frame elements may include internal flow regulating formations that are configured to divide the flotation chamber into discrete sub-chambers, such that, during flooding of the flotation chamber, the sub-chambers flood in consecutive order, causing the frame to tilt, thereby facilitating submersion of the frame. In addition, the internal flow regulating formations may be configured to divide the flotation chamber into discrete sub-chambers such that air pumped into the flotation chamber acts to displace water from the sub-chambers in consecutive order, thereby facilitating substantially complete discharge of water from the flotation chamber.

A pump may be positioned on the drainage sheet to pump water from between the hull and the drainage sheet during and after the barrier sheet is moved into the operative position.

The submersible barrier assembly may include one or more support slings for supporting the barrier sheet and drainage sheet in their inoperative position. The submersible barrier assembly may further include a barrier sheet 36 for locating between the hull and the support slings. Each sling may include a pair of support rods, and a support sheet for fastening between the support rods.

The slings facilitate the removal of water from between the hull and the drainage and barrier sheets when they are moved into their operative position.

The invention is now described, by way of example, with reference to the accompanying drawings. The following description is not to be regarded as limiting the broad scope of the appended claims and the preceding summary.

DETAILED DESCRIPTION OF THE DRAWINGS

Figure 1:
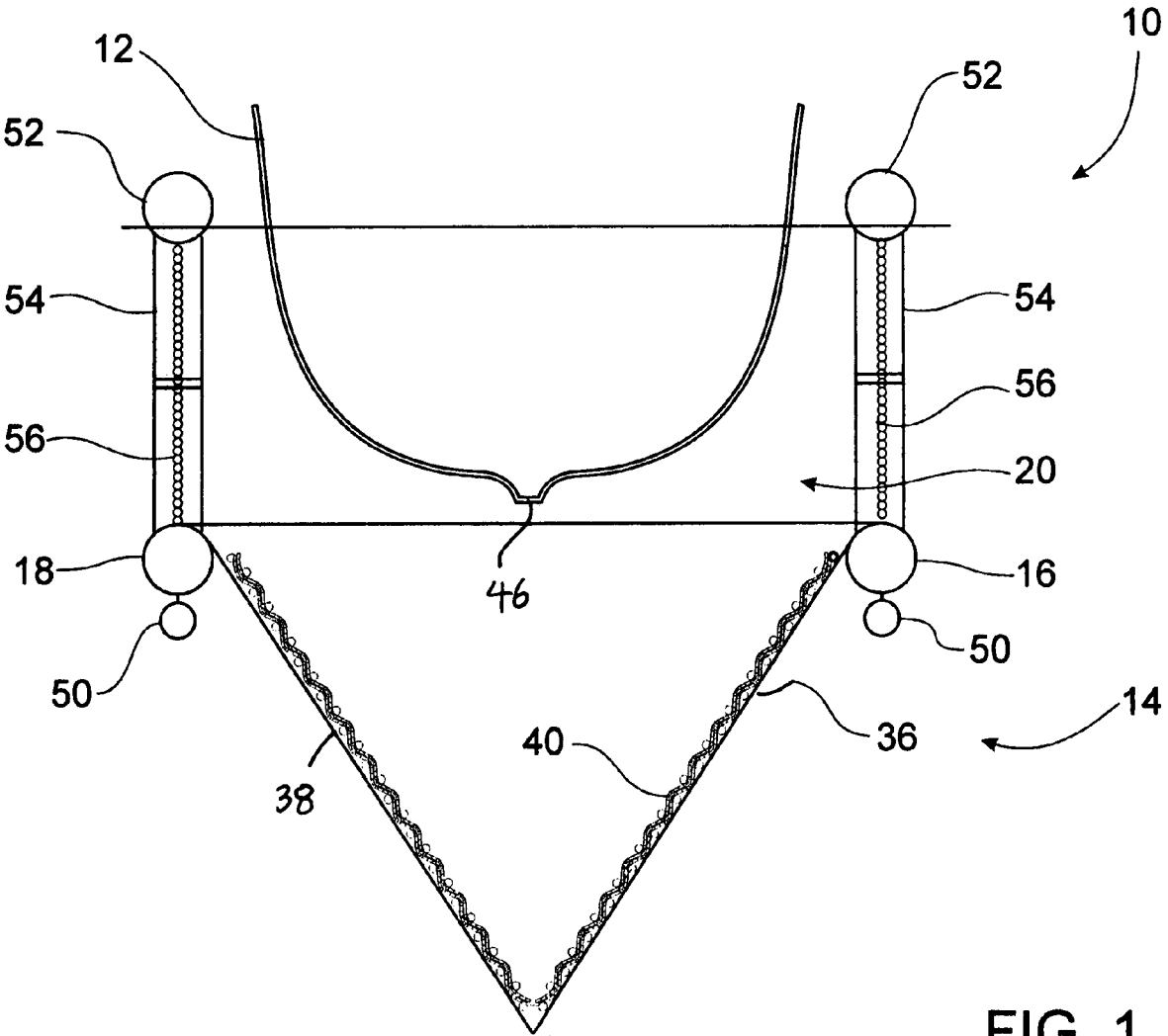
FIG. 1 shows a schematic sectioned end view of an apparatus, in accordance with the invention, for protecting the hull of a watercraft, in an inoperative condition.
Figure 2:
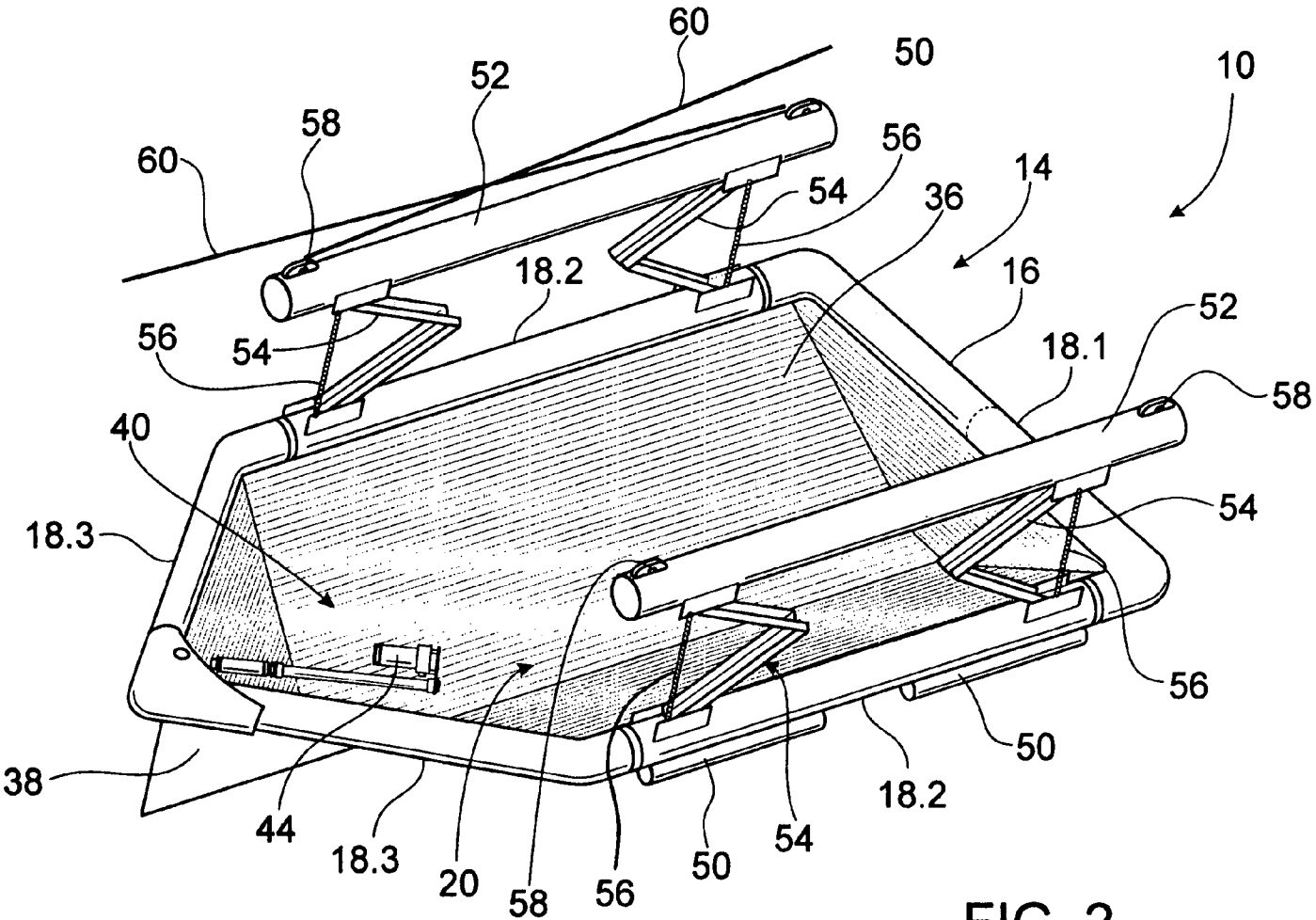
FIG. 2 shows a three dimensional view of the apparatus in the inoperative condition.

In the drawings, reference numeral 10 generally indicates an apparatus, in accordance with the invention, for protecting the hull 12 of a watercraft.

Figure 4:
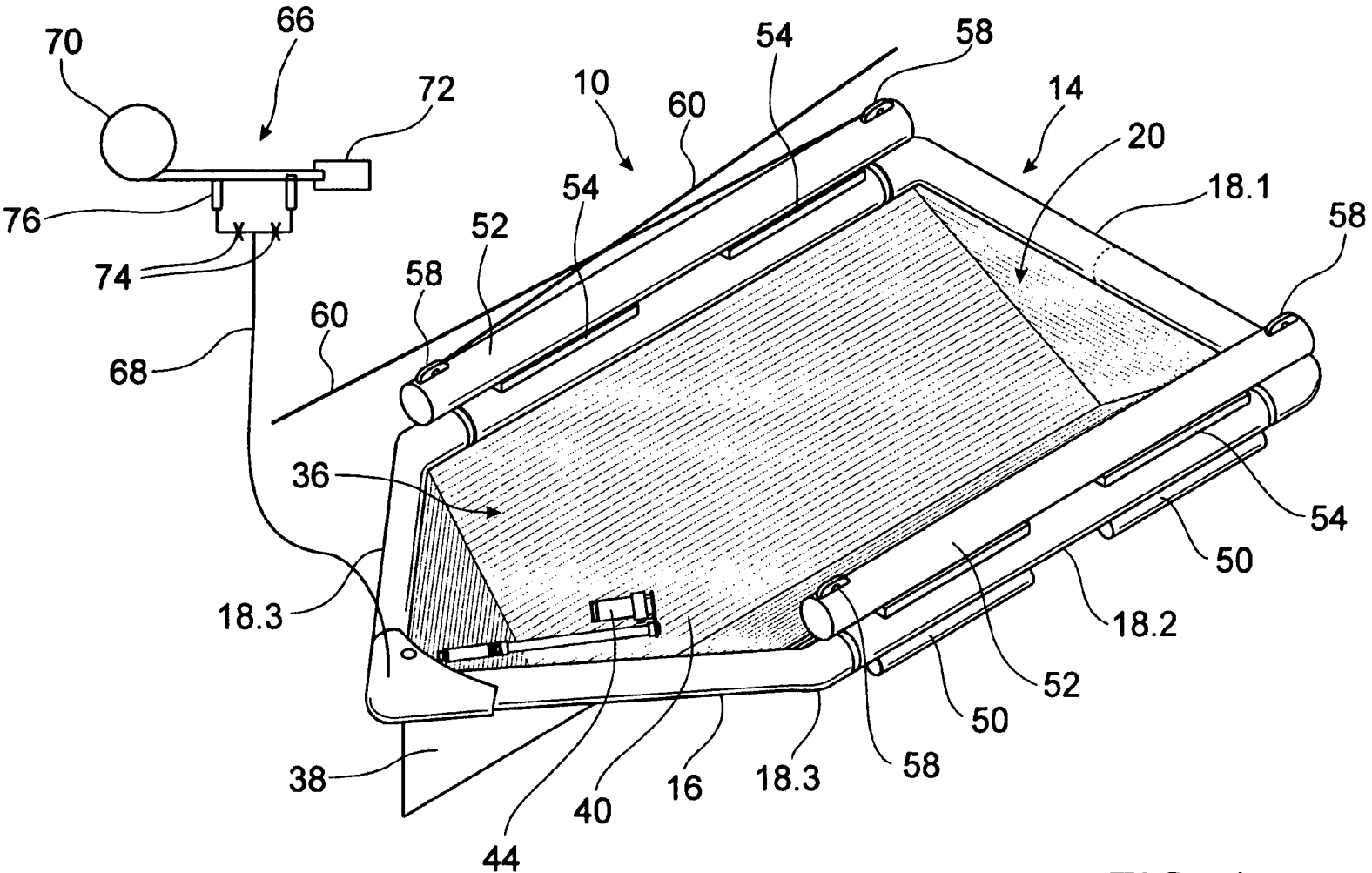
FIG. 4 shows a three dimensional view of the apparatus in an operative condition.

The apparatus 10 includes a submersible barrier assembly 14. The assembly 14 includes a submersible frame 16 of tubular frame elements 18 which are connected together to define a docking zone 20. The tubular frame elements 18 together define a flotation chamber 22 which can be flooded and evacuated to submerge and raise the frame 16. As can be seen in FIG. 4, an air pump assembly 66 is connected to the frame 16 with a suitable conduit 68 to be in fluid communication with the flotation chamber 22. The air pump assembly 66 includes an air pump 70 and a silencer 72. The assembly 66 further includes suitable valves 74 and a venturi 76 to facilitate the generation of a vacuum. The pump assembly 66 is used to drive water from the flotation chamber 22 when it is necessary to raise the frame 16.

Figure 5:
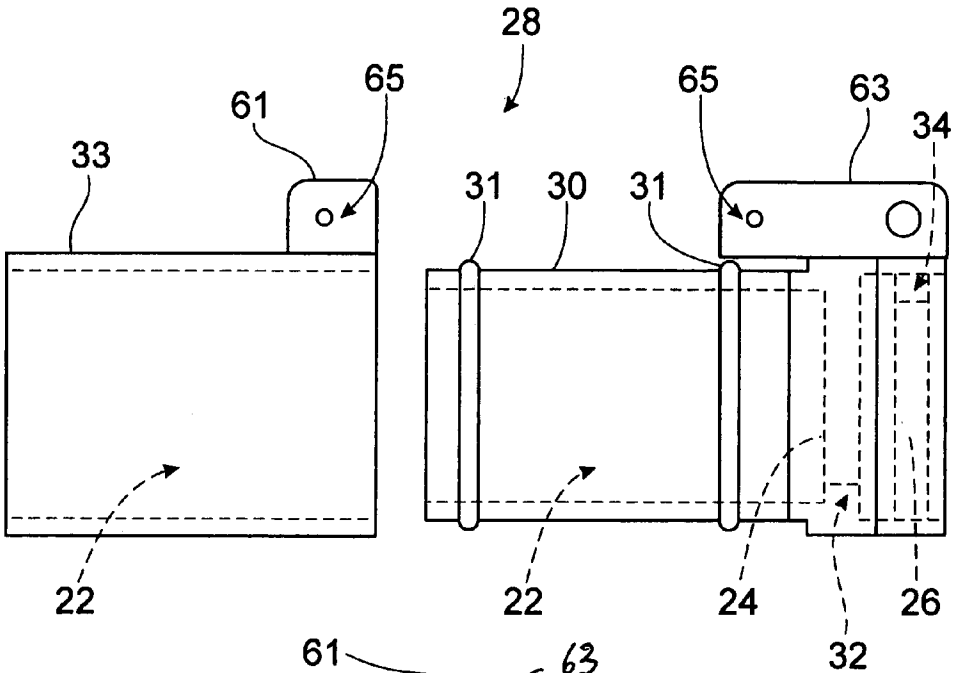
FIG. 5 shows a side view of a slip coupling assembly of two frame elements of the apparatus.
Figure 6:
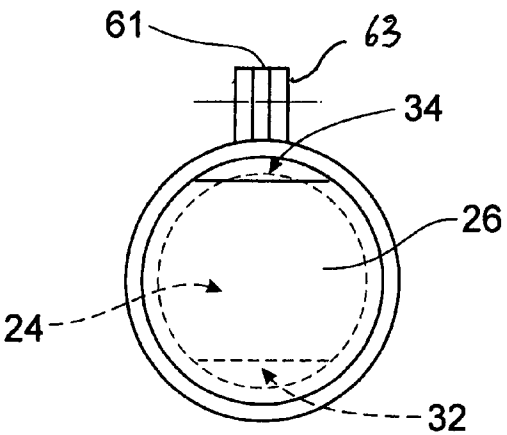
FIG. 6 shows an end view of a male member of the slip coupling assembly.

The frame elements 18 are connected together with slip coupling assemblies 28, details of one shown in FIGS. 5 and 6. The slip coupling assembly 28 includes a male coupling member 30 received in a female coupling member 33. The members 30, 33 form part of adjacent frame elements 18 so that the frame elements 18 can be connected together. A pair of O-rings 31 is mounted on the male member 30 to seal the members 30, 33 with respect to each other and thus maintain the flotation chamber 22. A connecting formation 61 extends from the female member 33 and engages a complementary connecting formation 63 extending from the male member 30. The formations 61, 62 have complementary openings 65 to permit the formations 61, 62 to be connected together with a suitable fastener received through the openings 65.

Each slip coupling assembly incorporates a series of pairs of baffles, each pair comprising a front baffle 24 and a rear baffle 26. Each pair of baffles 24, 26 is provided at a slip coupling assembly 28. Each pair of the baffles 24, 26 is provided in a male slip coupling member 30.

The front baffle 24 of each pair is configured to provide a passage 32 at an operatively lower region of the male member 30. The rear baffle 26 is configured to provide a passage 34 in an operatively upper region of the male member 30. Thus, it will be appreciated that when air is pumped into the flotation chamber 22 from a front of the frame 16 with the discharge port/s at a rear of the frame 16, the orientation of the baffles 24, 26 prevents the air from simply blowing over the top of a body of water within the flotation chamber 22. In particular, the baffles 24, 26 serve to constrain the air to drive the water out of the respective tubular elements 18. Furthermore, when the discharge port is open for flooding, it will be appreciated that a stern or rearmost frame element 18.1 is flooded first with the baffles 24, 26 interposed between the rear frame element 18.1 and a pair of opposed intermediate frame elements 18.2 serving to ensure that the rear frame element 18.1 is substantially filled before water begins entering the intermediate frame elements 18.2. Likewise, the baffles 24, 26 positioned between the intermediate frame elements 18.2 and a pair of opposed front frame elements 18.3 cause the intermediate frame elements 18.2 to be substantially filled with water before the water enters the front frame elements 18.3. In this manner, the submersible frame 16 is efficiently submerged. Furthermore, the orientation of the frame as it is submerged facilitates the escape of air. The pump assembly 66 is configured to generate a vacuum further to facilitate the escape of air from the flotation chamber 22.

The frame element 18.1 has a full baffle 64. Discharge ports 62 are positioned on respective sides of the baffle 64. This facilitates removal of substantially all of the water out of the frame 16 during pump operation. The full baffle 64 also facilitates flooding of the frame 16 via the ports 62.

Instead of using the coupling assemblies 28, the baffles 24, 26 can be fastened (such as by welding, particularly butt welding) directly to the frame elements 18. Thus, the frame 16 would form a completely welded structure.

Figure 8:
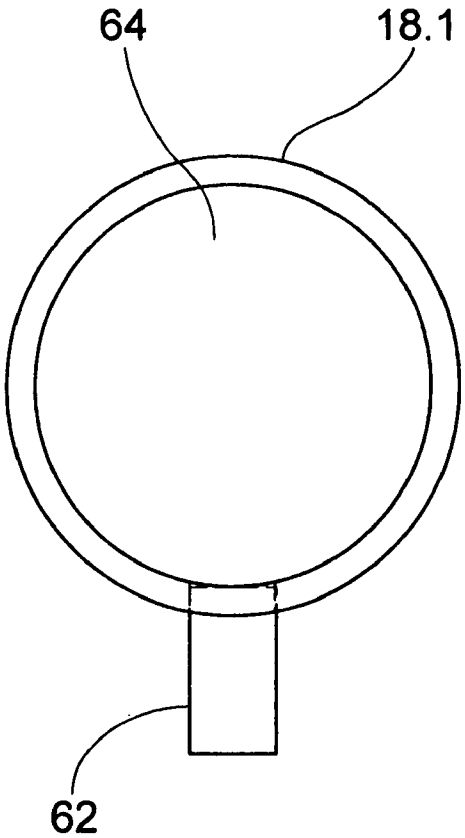
FIG. 8 shows a schematic, sectioned end view of the rear frame element of FIG. 7 with one of the discharge ports.
Figure 7:
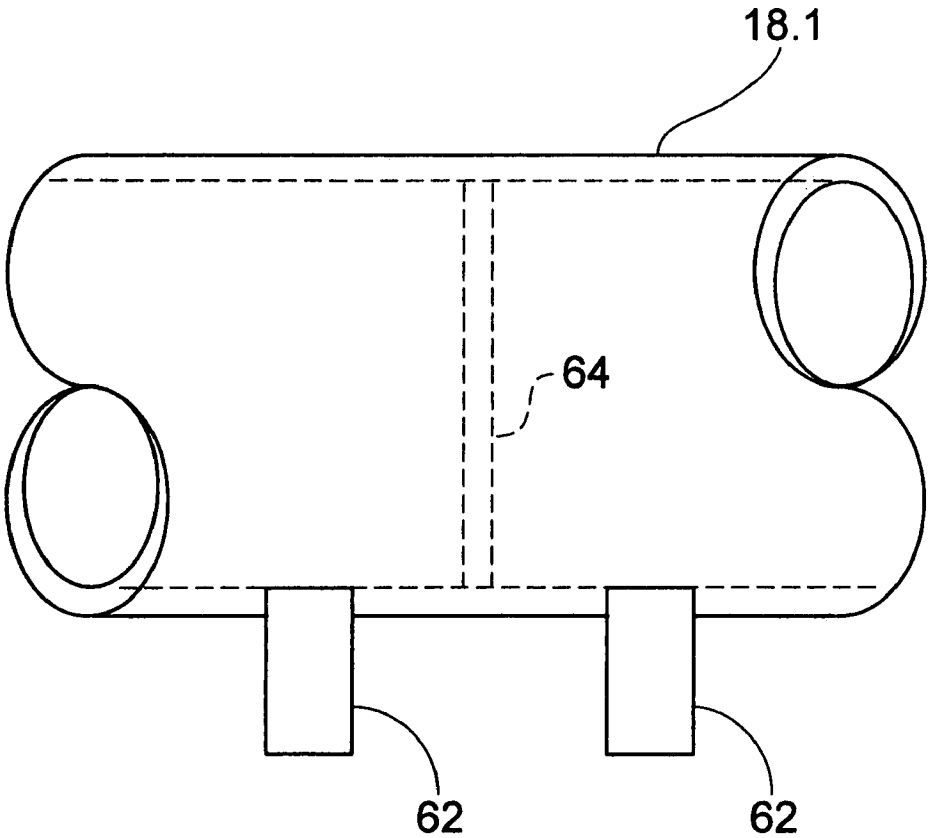
FIG. 7 shows, schematically, a plan view of part of a rear frame element with two discharge ports.
Figure 10:
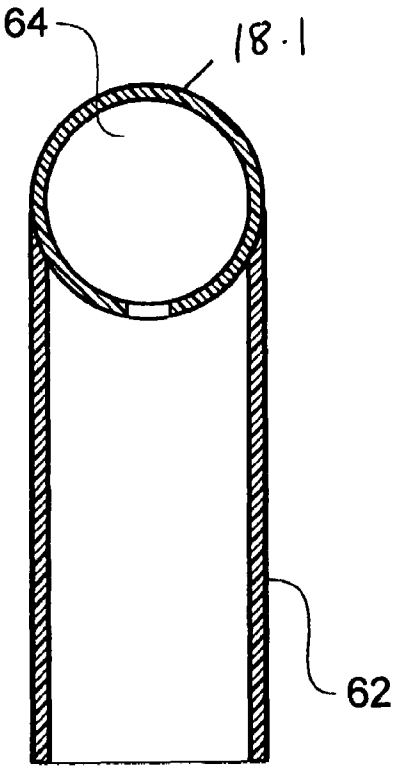
FIG. 10 shows a schematic, sectioned end view of the rear frame element of FIG. 9 with one of the discharge ports.
Figure 9:
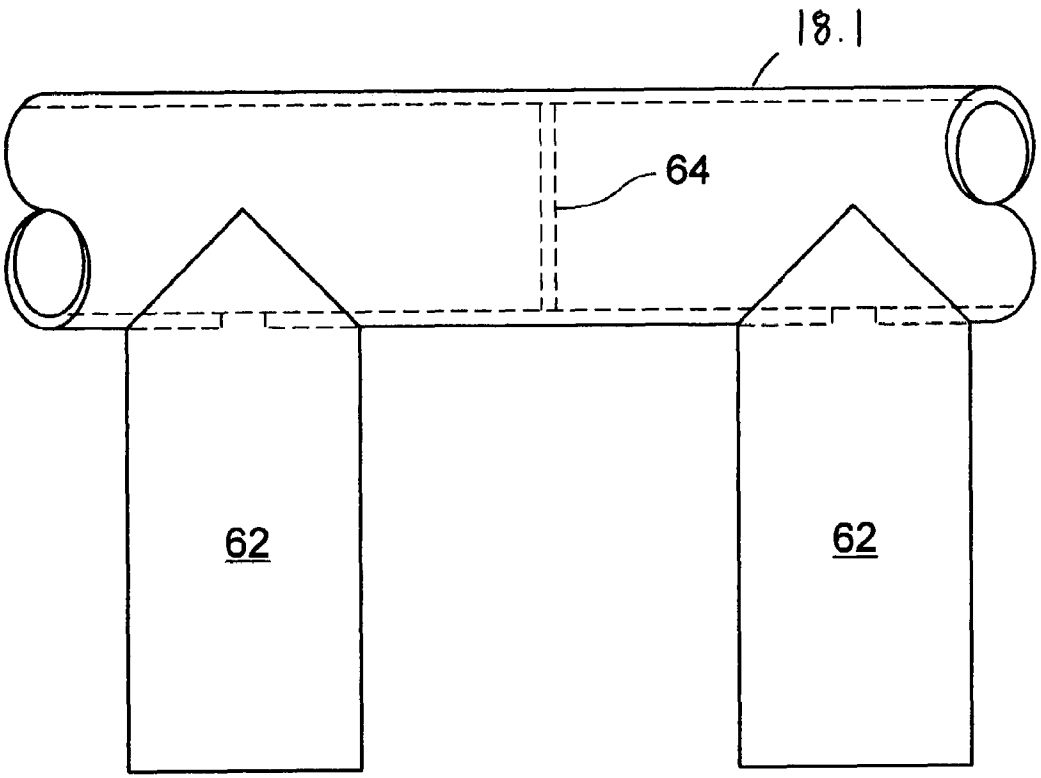
FIG. 9 shows, schematically, a plan view of part of another rear frame element with two discharge ports.

FIGS. 7 & 8 and 9 & 10 show two different embodiments of the discharge ports 62. In FIGS. 7 & 8, the discharge ports 62 are conventional in the sense that they are simply in the form of relatively narrow conduits from which water can be ejected from the flotation chamber 22. The discharge ports 62 in FIGS. 9 and 10 on the other hand are elongate and of a similar diameter to the elements 18. The ports 62 thus form exhaust lifters which assist lifting of the frame 16 when water is discharged from the chamber 22. In particular, they overcome the effects of ballast used to help in submerging the frame 18.

In one embodiment, internal buoyancy can be provided in part of the frame 16 to keep that part afloat, thus reducing the required pressure for displacing water from the frame. An example of a suitable part would be in one or both of the opposed front frame elements 18.3.

The submersible barrier assembly includes a barrier sheet 36 that is connected to the frame 16 to span the docking zone 20.

The barrier sheet 36 includes an outer skin 38 of a water-impervious material. The barrier sheet 36 further includes a drainage sheet in the form of a rope mat 40 positioned within the outer skin 38. The barrier sheet 36 is configured so that when the frame 16 is in a raised or operative condition, the rope mat 40 bears against the hull 12.

Figure 3:
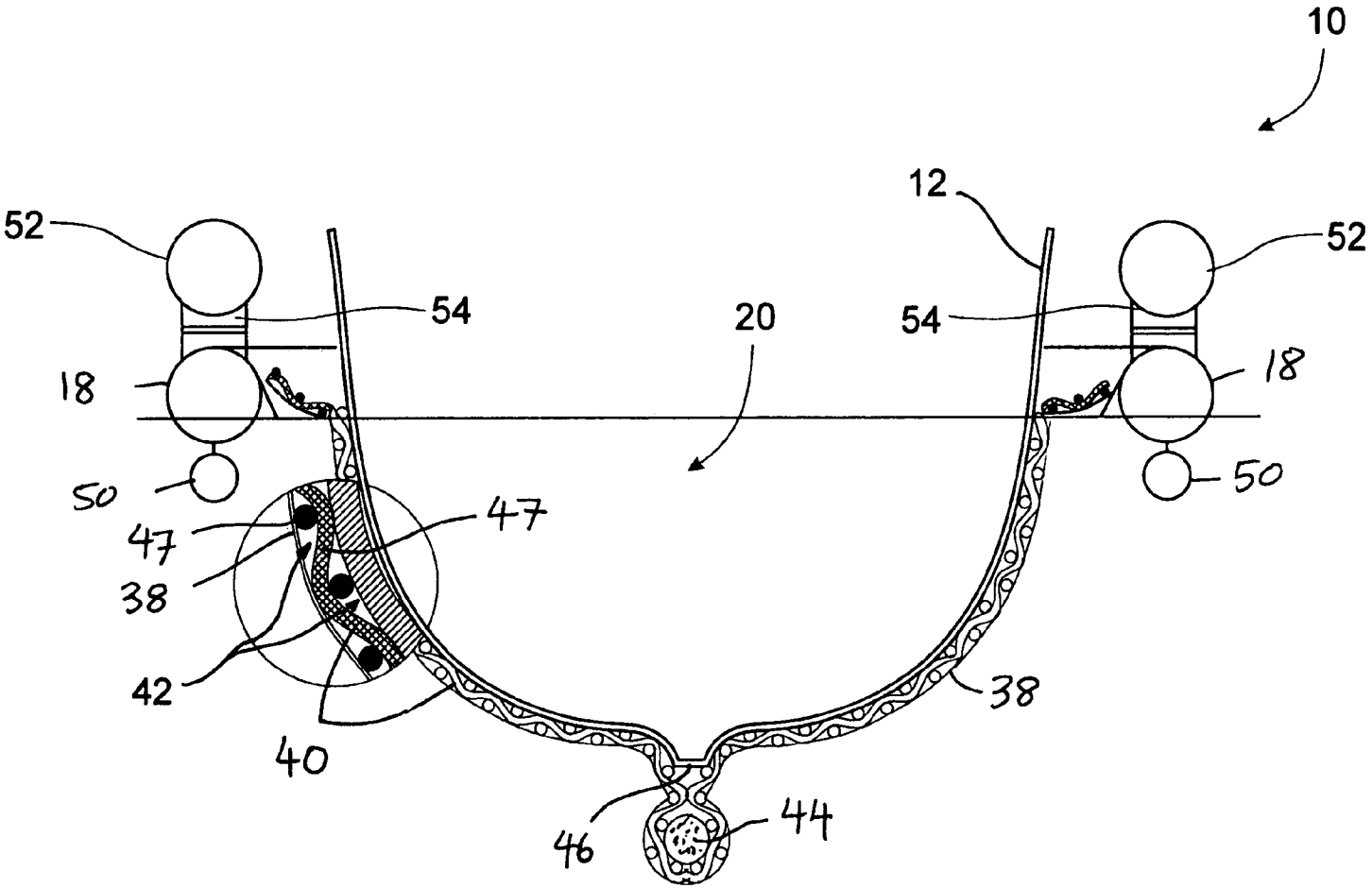
FIG. 3 shows a schematic sectioned end view of the apparatus in an operative condition.

As can be seen in FIG. 3, when the rope mat 40 bears against the hull 12, spaces 42 are defined between the skin 38 and the hull 12. Initially, these spaces are filled with water. The apparatus 10 includes a submersible pump 44 positioned centrally on the barrier sheet 36 to underlie a keel 46 of the hull 12.

Due to the high stresses applied to the barrier sheet 36, the rope mat 40 is of a suitably high strength. An example of a suitable rope mat is one which is fabricated or woven from 6 mm polypropylene rope 47 (FIG. 3).

The barrier sheet 36 is dimensioned so that, due to water pressure, the barrier sheet 36 can enclose the pump 44, as shown in FIG. 3.

During and after the barrier sheet 36 is raised into its operative position, the pump 44 serves to pump water away from a region between the skin 38 and the hull 12. The spaces 42 allow water to drain away from the hull and towards the pump 44 to be pumped out. Thus, an external surface of the hull 12 can be kept in a relatively dry condition without having to raise the boat out of the water.

A pair of ballast members 50 is mounted on each intermediate frame member 18.2 to enhance submersion of the frame 16.

The apparatus 10 includes a pair of spaced cylindrical floats 52 which are connected to respective intermediate frame elements 18.2. In particular, each float 52 is connected to its respective frame element 18.2 with a linked arm 54 and a suspension chain 56. The chain linked arm 54 allows relative linear movement between the floats 52 and the frame 16 during submersion and lifting of the frame 16. Furthermore, the suspension chain 56 prevents the frame 16 from descending too far. The coupling assemblies 28 each include connectors 57 to permit the linked arms 54 and suspension chains 56 to be connected to the frame 16.

Each of the floats 52 has a mooring formation 58 to permit the apparatus 10 to be moored with suitable mooring lines 60.

In use, a driver or pilot of the boat will steer the boat between the floats 52. The air pump and the submersible pump 44 can then be operated to raise the frame 16 into the position shown in FIGS. 3 and 4 and thus, when the boat is moored, the hull 12 can be kept relatively dry. It will be appreciated that this will inhibit fouling.

It is well known that barnacles and other forms of marine growth on a hull can greatly increase fuel consumption and reduce the performance of a boat. The apparatus 10 thus provides a means whereby such marine growth on the hull is, to a large extent, obviated.

Figure 11:
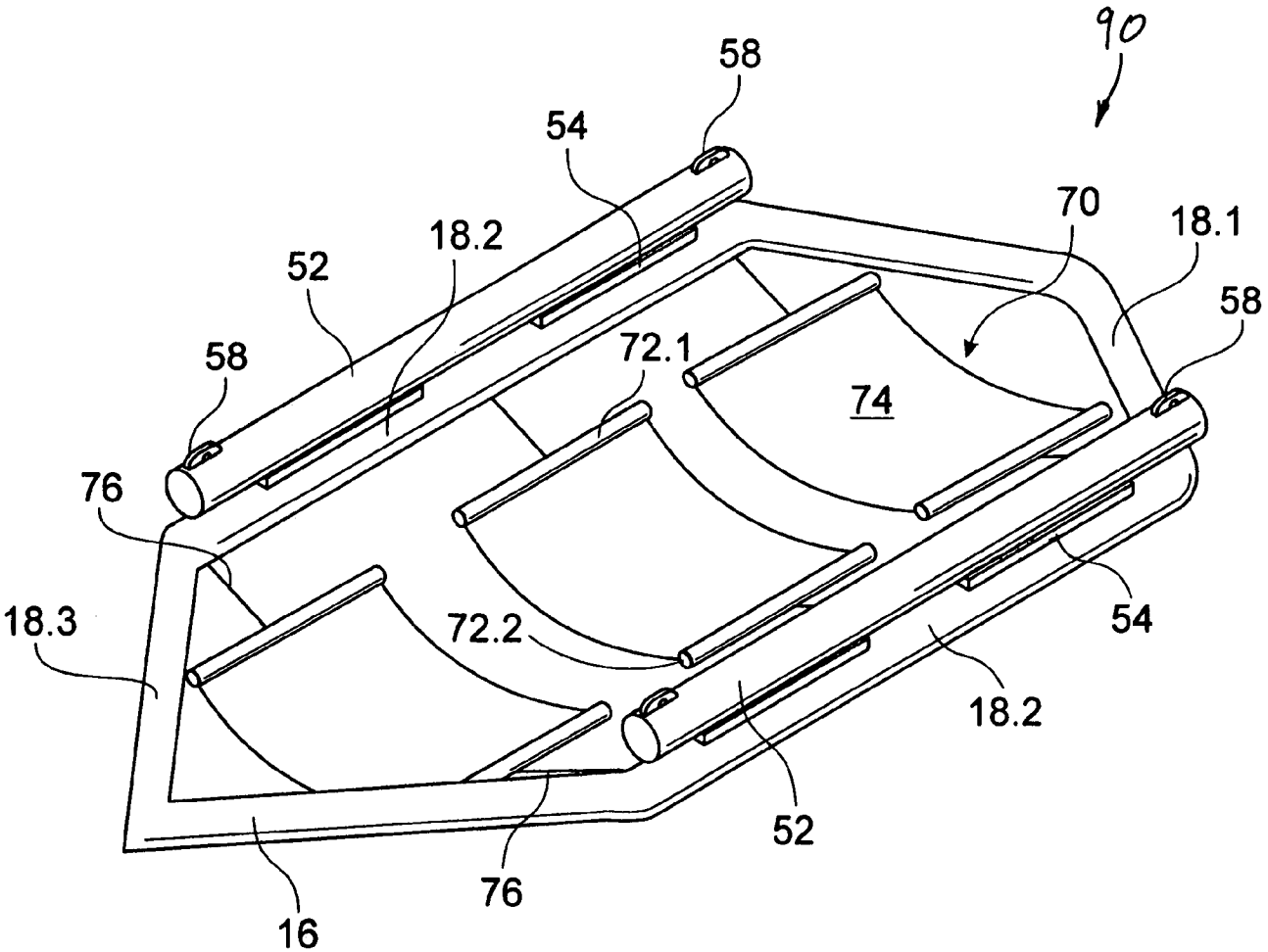
FIG. 11 shows a three dimensional view of an apparatus, in accordance with another embodiment of the invention, for protecting the hull of a watercraft, in an operative condition.

A further embodiment of the present invention is generally indicated by reference numeral 90 in FIG. 11. Like reference numerals shown in FIG. 11 relate to like features previously described with reference to the foregoing embodiment. In FIG. 11, the barrier sheet 36 is not shown for the purposes of clarity only.

The apparatus 90 includes a submersible frame 16 of tubular frame elements 18 which define a docking zone in which the watercraft is received. The apparatus 10 includes a pair of spaced parallel cylindrical floats 52 which are connected to respective intermediate frame elements 18.2. As previously described, each float 52 is connected to its respective frame element 18.2 with a linked arm 54 and a suspension chain.

The apparatus 10 includes a triplet of support slings 70 for supporting the barrier sheet 36 and the rope mat 40 in their inoperative positions. The slings 70 are mounted in parallel between the intermediate frame elements 18.2. The barrier sheet 36 can be draped over the apparatus 10 to be located between the hull of the watercraft and the slings 70. The slings 70 serve to facilitate the removal of water from between the hull 12 and the barrier sheet 36 as the rope mat 40 and barrier sheet 36 are moved into their operative position.

Each sling 70 includes a pair of support rods 72 and a support sheet 74 which is fast between the support rods 72. The support sheet 74 is typically made from water-impervious material. Each support rod 72 includes a lug (not shown) to which a rope 76 can be tied. In this manner, a respective rope 76 can be tied between each support rod 72 and an intermediate frame element 18.2 so as to support the sling 70.

The ropes 76 permit adjustment of the amount of slack of each sling 70. In this manner, the barrier sheet 36 can form a shallow trough in use which desirably enables the apparatus 10 to be used in shallow water and limits the amount of water contained in the trough.

Figure 12:
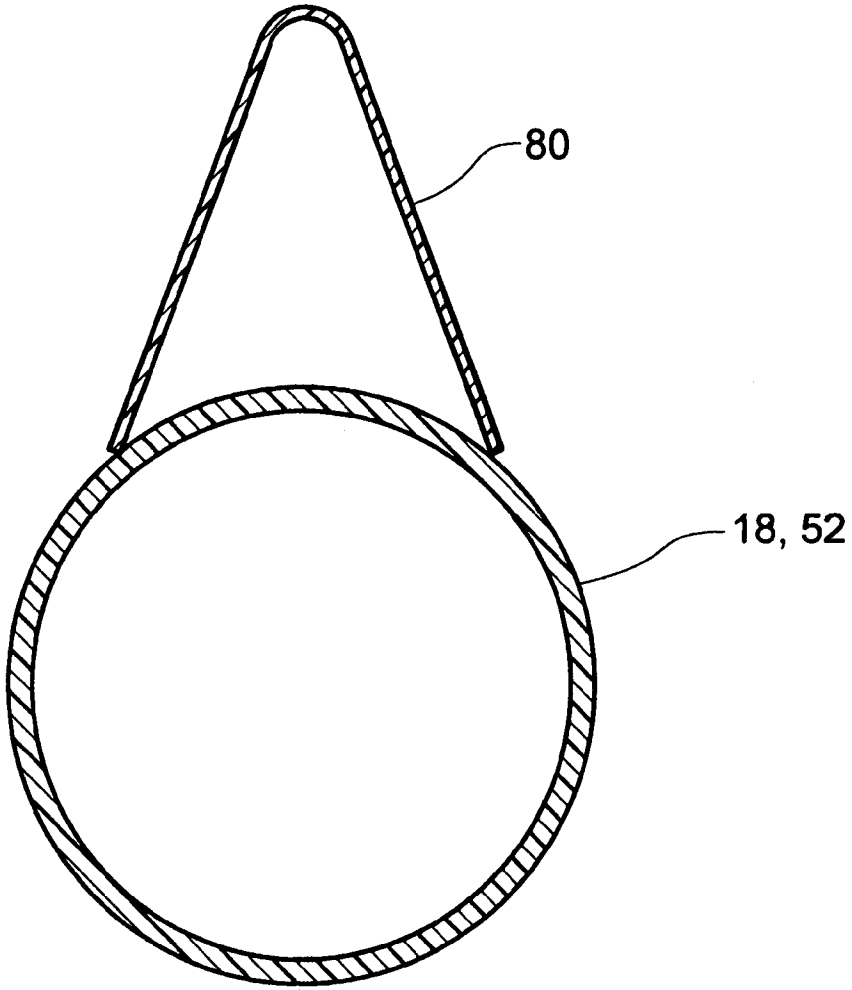
FIG. 12 shows a sectioned end view of a splash guard to be fitted to the apparatus.

Referring to FIG. 12, a plurality of splash guards 80 can each be fitted to the roof of a respective cylindrical float 52 and frame element 18.1, 18.3 when the apparatus 10 is in its operative condition. The splash guard 80 defines a barrier to impede water from splashing into the barrier sheet 36. Typically, the splash guards 80 are elbow brackets which are integrally molded from plastics material.

In compliance with the statute, the invention has been described in language more or less specific to structural or methodical features. It is to be understood that the invention is not limited to specific features shown or described since the means herein described comprises preferred forms of putting the invention into effect.

The invention is defined in the following claims:

1. An apparatus for protecting the hull of a watercraft, the apparatus comprising:

a support;

a submersible barrier assembly connected to the support and displaceable with respect to the support between an inoperative, submerged position and an operative surface position, the barrier assembly being configured to cover at least a submerged portion of the hull in the operative position, the barrier assembly having a frame that bounds a docking zone for receiving the hull, said frame having a barrier sheet spanning the docking zone, the barrier sheet including a water-impervious sheet and a drainage sheet that is positioned on the water impervious sheet such that the drainage sheet is interposed between the hull and the water-impervious sheet in the operative position, the drainage sheet permitting water to drain from the hull; and a displacement mechanism operable on the barrier assembly to displace the barrier assembly between the inoperative and operative positions.

2. An apparatus as claimed in claim 1, in which the support is in the form of a pair of spaced floats positioned to permit a watercraft to be positioned between the floats when the barrier assembly is submerged.

3. An apparatus as claimed in claim 1, in which the drainage sheet is of a woven material.

4. An apparatus as claimed in claim 1, in which the drainage sheet is in the form of a rope mat.

5. An apparatus as claimed in claim 4, in which the rope mat is woven of rope of a plastics material.

6. An apparatus as claimed in claim 5, in which the rope mat is woven of polypropylene rope.

7. An apparatus as claimed in claim 1, in which the frame is comprised of a number of tubular frame elements that together define a flotation chamber which can be flooded and evacuated to submerge and raise the frame, respectively.

8. An apparatus as claimed in claim 7, in which the frame elements include internal flow regulating formations that are configured to divide the flotation chamber into discrete sub-chambers, such that, during flooding of the flotation chamber, the sub-chambers flood in consecutive order, causing the frame to tilt, thereby facilitating submersion of the frame.

9. An apparatus as claimed in claim 7, in which the frame elements include internal flow regulating formations that are configured to divide the flotation chamber into discrete sub-chambers such that air pumped into the flotation chamber acts to displace water from the sub-chambers in consecutive order, thereby facilitating substantially complete discharge of water from the flotation chamber.

10. An apparatus as claimed in claim 1, in which a pump is positioned on the drainage sheet to pump water from between the hull and the drainage sheet during and after the barrier sheet is moved into the operative position.

11. An apparatus as claimed in 7, which includes a number of support slings for supporting the water-impervious sheet and the drainage sheet in their inoperative positions.

12. An apparatus as claimed in claim 11, in which the slings are mounted in parallel between opposed frame elements.

13. An apparatus as claimed in claim 12, in which the barrier assembly is located between the hull of the watercraft and the slings, when the watercraft is received in the frame.

14. A method for fabricating an apparatus for protecting the hull of a watercraft, the method comprising:

providing a submersible barrier assembly connected to a support and displaceable with respect to the support between an inoperative, submerged position and an operative surface position, the barrier assembly being configured to cover at least a submerged portion of the hull in the operative position, the barrier assembly having a frame that bounds a docking zone for receiving the hull, said frame having a barrier sheet spanning the docking zone, the barrier sheet including a water-impervious sheet and a drainage sheet that is positioned on the water impervious sheet such that the drainage sheet is interposed between the hull and the water-impervious sheet in the operative position, the drainage sheet permitting water to drain from the hull; and providing a displacement mechanism operable on the barrier assembly to displace the barrier assembly between the inoperative and operative positions.

15. A method as claimed in claim 14, in which the drainage sheet is of a woven material.

16. A method as claimed in claim 14, in which the drainage sheet is in the form of a rope mat.

17. A method as claimed in claim 16, in which the rope mat is woven of rope of a plastics material.

18. A method as claimed in claim 17, in which the rope mat is woven of polypropylene rope.

19. A method for operating the apparatus of claim 1, the method comprising operating the displacement mechanism to displace the barrier assembly between the inoperative and operative positions.

20. A method as claimed in claim 19, in which a pump is positioned on the drainage sheet to pump water from between the hull and the drainage sheet during and after the barrier sheet is moved into the operative position.

* * * * *